US006929488B2

(12) United States Patent
Kung et al.

(10) Patent No.: US 6,929,488 B2
(45) Date of Patent: Aug. 16, 2005

(54) ELECTRICAL CONNECTION DEVICE BETWEEN A PIN-TYPED IC PACKAGE AND A CIRCUIT BOARD

(75) Inventors: Moriss Kung, Taipei (TW); Kwun-Yao Ho, Taipei (TW)

(73) Assignee: VIA Technologies, Inc., Taipei (TW)

( * ) Notice: Subject to any disclaimer, the term of this patent is extended or adjusted under 35 U.S.C. 154(b) by 0 days.

(21) Appl. No.: 10/679,403

(22) Filed: Oct. 7, 2003

(65) Prior Publication Data

US 2004/0072462 A1 Apr. 15, 2004

(30) Foreign Application Priority Data

Oct. 8, 2002 (TW) ..... 91215898 U

(51) Int. Cl.[7] ..... H01R 12/00
(52) U.S. Cl. ..... 439/83; 439/936
(58) Field of Search ..... 439/83, 342, 936, 439/876

(56) References Cited

U.S. PATENT DOCUMENTS 5,791,929 A * 8/1998 Banakis et al. ..... 439/342
5,989,049 A * 11/1999 Walkup et al. ..... 439/342
6,099,326 A * 8/2000 Lin ..... 439/83
6,142,810 A * 11/2000 Hsiao et al. ..... 439/342
6,572,397 B2 * 6/2003 Ju ..... 439/342
6,702,594 B2 * 3/2004 Lee et al. ..... 439/83
6,774,314 B2 * 8/2004 Toyoshima et al. ..... 174/260

* cited by examiner

*Primary Examiner*—Neil Abrams
(74) *Attorney, Agent, or Firm*—Birch, Stewart, Kolasch & Birch, LLP

(57) ABSTRACT

An electrical connection device comprises a socket and a plurality of holders. A plurality of pinholes arranged on the socket provide a plug-in function for a plurality of pins of an IC device. A conductive holder placed in the pinhole is a single element made integrally by bending a metallic piece. The holder includes: an extension part arranged along the extension direction of pin-hole, a holding part located at the top end of the extension part, and an electrical connection part located at the bottom end of the extension part. The electrical connection part is a hollow structure having an accommodation inner space. The electrical connection part has a pouring opening so that the hollow structure may be filled with resin.

13 Claims, 10 Drawing Sheets

ELECTRICAL CONNECTION DEVICE BETWEEN A PIN-TYPED IC PACKAGE AND A CIRCUIT BOARD

This Nonprovisional application claims priority under 35 U.S.C. §119(a) on Patent Application No. 91215898 filed in TAIWAN on Oct. 8, 2002, the entire contents of which are hereby incorporated by reference.

FIELD OF THE INVENTION

The invention relates to an electrical connection device, and in particular, to a structural improvement for an electrical connection device that provide an electrical connection between a pin-type IC device and a circuit board.

BACKGROUND OF THE INVENTION

Since long time ago, there are two kinds of traditional manner to place integrated circuit package (abbreviated as IC package) on a circuit board (or called main board): one manner is directly welding wherein the IC package can not be pulled out, and another manner is replaceable wherein the IC package can be pulled out. The replaceable assembly device of an electrical connection device and a circuit board is usually adapted for IC package that needs upgrade or renew. And, when one of the circuit board or the IC package is out of order, another element still be remained for continuous usage. The assembly device of a socket and a circuit board for central processing unit (abbreviated as CPU) plugged in computer is a typical example.

Please refer to FIG. 1 and FIG. 2, which are illustrations for a replaceable assembly device typically seen in current market for assembling an IC package and its electric connector to a circuit board. In tradition, for the purposes of both replaceable and excellent connection, the common method is to arrange pins 111 on the IC package 11 and arrange electric connector 13 having plural pinholes on the circuit board 12 (or called main board) to place the IC package 11. Prior manners for packing IC package 11 are lead frame and ball grid array (abbreviated as BGA). Recently, for the IC package pursuing high performance (i.e., high heat dissipation) and high pin count, a flip chip BGA package is usually used. As shown in FIG. 1, its essential components are usually comprised of: an IC chip 112, which is arranged on one side surface of a substrate 113 by flip chip method; several solders, which are arranged on another side surface of the substrate 113, and which are electrically coupled to chip 112 by the circuit design of the substrate 113; and chip 112, another non-active surface of which is pasted with a heat sink 115. Since the pin 111 is not an object with extremely high rigidity, so it is easily twisted and damaged during the plugging and pulling procedures. The pin 111 is also uneasily connected to the solder 114 firmly so, according to the current techniques, plural pins 111 must be fixed on an interposer before being welded to the solder 114.

As regarding to be plugged through the pin 111 of the prior IC package 11 and have the replaceable function, the prior pin-type electric connector 13 currently used all includes following components: a socket 132, which has plural pinholes 131 and is welded on the circuit board 12; a sliding plate 133, which is arranged over the top face of the socket 132 by a linearly sliding manner; and a long pulling rod 134, which is arranged at one side of the socket 132 for driving the sliding plate 133 to proceed a slight slide. In each pinhole 131 of the socket 132, a holder 137 is arranged. And, there is a solder pad 135 formed at the bottom of the pinhole 131. The lower end of the holder 137 is extended out of the bottom of the pinhole 131 to form pin 1371 that will be plugged into the penetration hole 121 of the circuit board 12. A conducting layer 122 is arranged in the penetration hole 121 of the circuit board 12 for being electrically connected to the pin 1371. On the upper surface of the circuit board 122, solder mask 124 is used to define the penetration hole 121 and the contact pad 1221 thereon. The pin 1371 together with the socket 13 is welded fixedly upon the circuit board 12 by solder material 123, 125. A lightly larger opening (not shown in the figures) is arranged at the position corresponding to the pin 131 on the sliding plate 133. Pressing down the long pulling rod 134 will make it rotate around the rod axis 136 until it is horizontal to the socket 132, such that the sliding plate 133 proceeds a slightly sliding movement to fix the pin 111 of the IC package 11 into the pinhole 131. When the IC package 11 is going to be pulled out, then it is necessary to rotate the long pulling rod 134 to become 90 degrees vertically to the socket 132, such that the pin 111 will be loosened to take out the IC package 11.

Please refer to FIG. 3 and FIG. 4, which show another replaceable assembling device according to prior art for connecting an IC package and a socket to a circuit board. Since the structures of the IC package 11 and the electric connector 13*a* according to this prior art are substantially same as those of the prior art described in FIG. 1, so its assembling components and structures are not described in detail herein, but only an illustration drawn by broken lines shows its entire outer appearance of assembly. As shown in FIG. 3, the biggest difference between this electric connector 13*a* and the one described in aforementioned prior art is that the bottom of the electric connector 13*a* is not shown as pin-typed structure but uses several solder balls 138. And, the lower end of the holder 137*a* in the electric connector 13*a* is bent directly to 90 degrees to be acted as a pad 139 connected to the solder ball 138. Instead of arranging penetration hole, a solder pad 126 is arranged on the circuit board 12*a*. Making the solder ball 138 of the electric connector 13*a* and the solder pad 126 on the circuit board 12*a* proceed a corresponding hot welding process (the so-called solder pot or solder reflow process) will melt the solder ball 138 and weld it fixedly between two pads 139, 126. The shortcoming of this prior art is that: for both the pad 139 arranged at the lower end of the holder 137 of the electric connector 13*a* and the solder pad 126 arranged upon the circuit board 12*a*, they are all structures of simple plane, so the solder ball 138 is connected to the pads 139, 126 by plane contact. Therefore, the electric characteristic is relatively poor because of small contact surface, and the structural strength of connection is also relatively poor. So, the product yield is low, and the solder ball 138 even drops off. In the hot welding process, the material of solder ball 138 is overflowed to cause short circuit and electric unsteadiness. In the meantime, the co-planarity between the electric connector 13*a* and the circuit board 12*a* is often in poor condition after they are connected together.

SUMMARY OF THE INVENTION

The main objective of the invention is to provide an electrical connection device, wherein by the appropriately structural design of a conductive holder, the electrical connection device can provide preferable electric characteristic and co-planarity between the electrical connection part at the lower end of the holder and a circuit board to increase production efficiency, and production yield.

The secondary objective of the invention is to provide an electrical connection device, wherein by filling a resin material in the electrical connection part arranged at the lower end of the holder, the electrical connection device can provide preferable structural strength between the holder and a circuit board.

To achieve aforementioned objective, an electrical connection device according to the invention is provided for an electric connection of an outside pin-typed IC package. The electrical connection device at least includes a conductive holder made by bending a metallic piece into a single component. The holder further includes an extension part, a holding part, and an electrical connection part. The holding part is located at one end of the extension part and is shown a preset angle with the extension part. By bending the holding part, an opening is formed to receive a pin plugged and contacted. The electrical connection part is located at another end of the extension part and is shown as a hollow structure having an accommodation inner space.

The electrical connection device further includes a socket with a plurality of pinholes arranged inside and corresponding to those pins of the IC package. And a plurality of the holders are respectively arranged in the pinholes.

For your esteemed members of reviewing committee to further understand and recognize the invention, a detailed description together with corresponding drawings are presented as follows.

DETAILED DESCRIPTION OF THE INVENTION

Several preferable embodiments are proposed thereinafter to describe the detailed means, action manners, achievable functions, and other technical characteristics of the electrical connection device and its using method according to the invention in detailed way.

Figure 5:
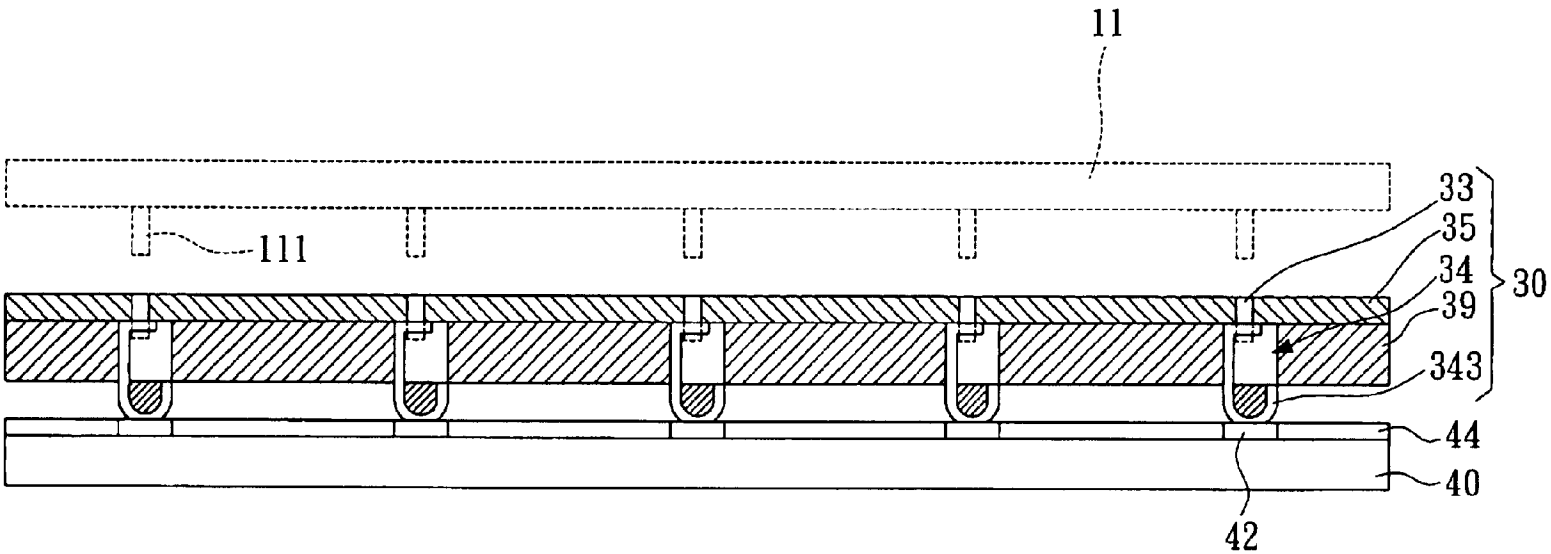
FIG. 5 is a side view illustration for the first preferable embodiment of the electrical connection device according to the invention.
Figure 6:
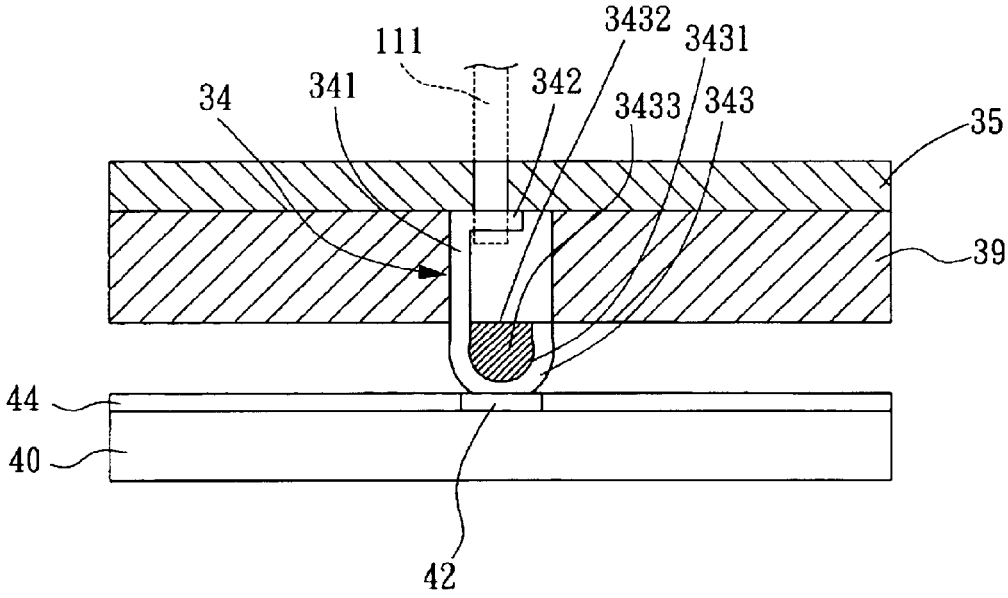
FIG. 6 is a partial enlargement illustration for the holder of the electrical connection device shown in FIG. 5.
Figure 7:
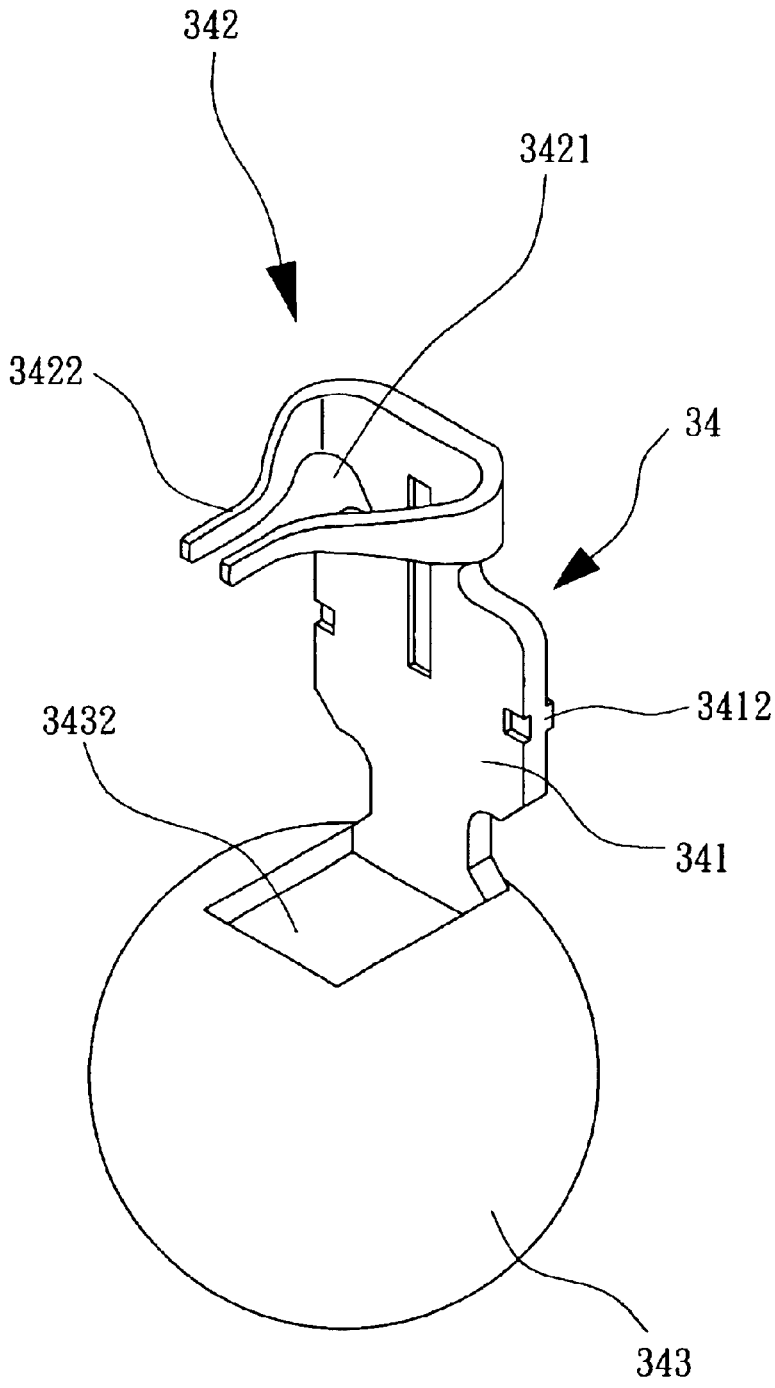
FIG. 7 is a 3-D structural illustration of the preferable embodiment of the holder of the electrical connection device shown in FIG. 5.

Please refer to FIG. 5, FIG. 6, and FIG. 7, which are side view illustrations for the first preferable embodiment of the electrical connection device 30 according to the invention. The electrical connection device 30 is applicable to an electric connection between a pin-typed IC package 11 and a circuit board 40 (or so-called main board), both of which are separable. In the preferable embodiment according to the invention, the IC package 11 has several pins 111, structure of which is same as that of prior arts which is not technical characteristic of the invention, so the detailed construction of an IC package 11 is not described herein, and only the contour of its outer appearance drawn by broken lines is roughly presented in each illustration.

The electrical connection device 30 includes: a socket 39, a sliding cover mechanism 35, plural conductive holders 34. In the preferable embodiment according to the invention, plural pinholes 33 corresponding to the sliding cover mechanism 35 are arranged upon the socket 39, and the positions of these pinholes 33 are also corresponding to those of plural pins 111 of the IC package 11, such that the IC package 11 be plugged into the pins 33 of the socket 39 and, if necessary, the IC package can be pulled out of the socket 39 as well.

Each of plural holders 34 is respectively accommodated in each corresponding plural pinhole 33. And, each holder 34 is made by bending a metallic piece into one single element. In the preferable embodiment according to the invention, the holder 34 be made of materials, such as; nickel, gold, chromium, copper, iron, aluminum, titanium, lead, tin, or other preferable alloy, etc., and its surface be plated with different metallic materials as well. Each holder 34 is respectively comprised of an extension part 341, a holding part 342, and an electrical connection part 343. The extension part 341 is arranged and extended along the extending direction of the pinhole 33. Several claw-wedging structures 3412 formed in concave-convex-shape are arranged at appropriate position of the extension part 341. The claw-wedging structure 3412 provides a clawing force at the inside wall surface of the pinhole 33 of the socket 39, such that it prevents the holder 34 from dropping off or displacing from the pinhole 33. The holding part 342 located at one end (top end) of the extension part 341 having a predetermined angle (for example, vertical angle) with the extension part 341 and is provided for the pin 111 to be plugged therein. As shown in FIG. 7, the holding part 342 includes two holding arms, each of which is extended along same direction and is spaced apart with an appropriate distance. By bending two holding arms, an accommodation opening 3421 with a larger spacing distance and a holding end 3422 with a smaller spacing distance are formed between the two arms. The spacing distance of the accommodation opening 3421 is larger than the diameter of the pin 111 for receiving the pin 111 plugged therein, and the spacing distance of the holding end 3422 is slightly smaller than the diameter of the pin 111 for providing a holding and positioning function. The electrical connection part 343 located at another end of the extension part 341 is shown as a hollow structure having an accommodation space 3431 and is made by stamping a metallic piece, for example. And, a pouring opening 3432 is arranged on a surface, of the electrical connection part 343, closer to the holding part 342. The accommodation space 3431 of the electrical connection part 343 is filled by a resin material 3433 therein via the pouring opening 3432 to make the conductive holder 34 have a preferable structural strength without influencing its electric characteristics.

Figure 1:
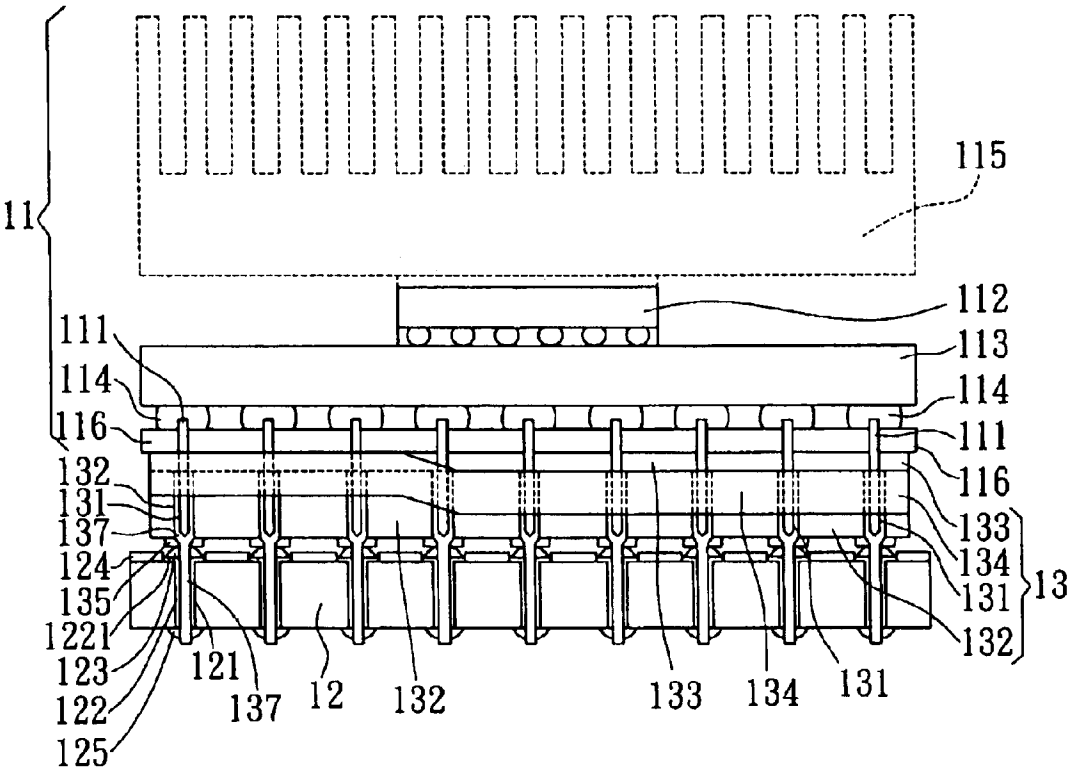
FIG. 1 PRIOR ART
FIG. 1 is a side perspective illustration for the assembly device according to prior arts for assembling the IC package, the pin-typed electric connector, and the circuit board together.
Figure 2:
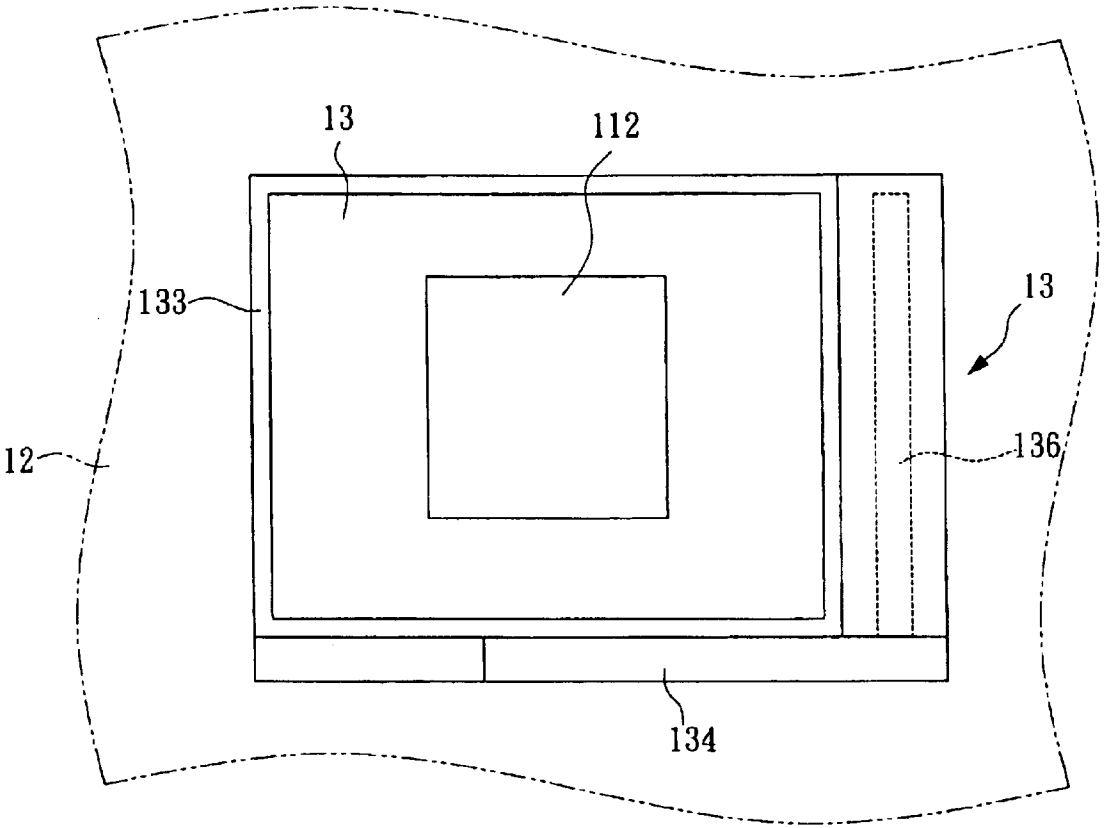
FIG. 2 PRIOR ART
FIG. 2 is a top view illustration for the assembly device according to prior arts shown in FIG. 1 for assembling the IC package, the pin-typed electric connector, and the circuit board together.
Figure 3:
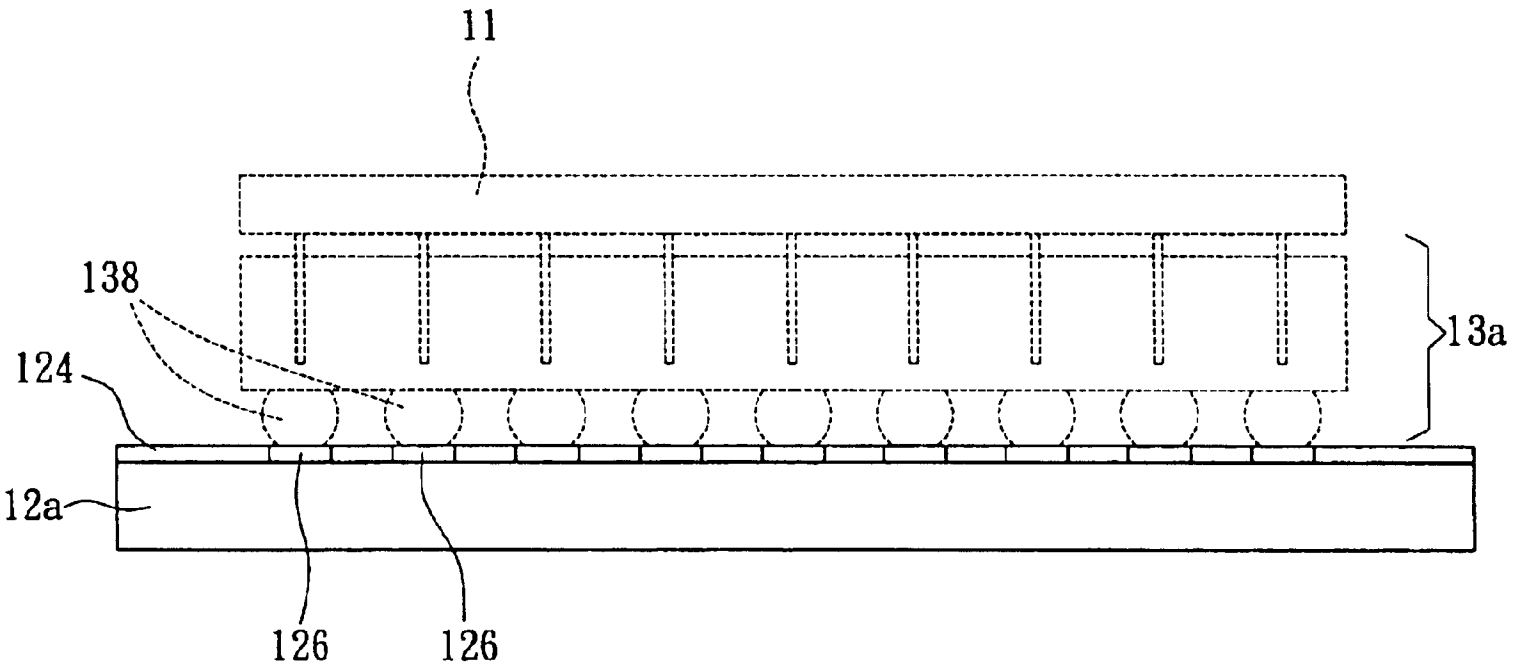
FIG. 3 PRIOR ART
FIG. 3 is a side view illustration for the assembly device according to prior arts for assembling the IC package, the ball-typed electric connector, and the circuit board together.
Figure 4:
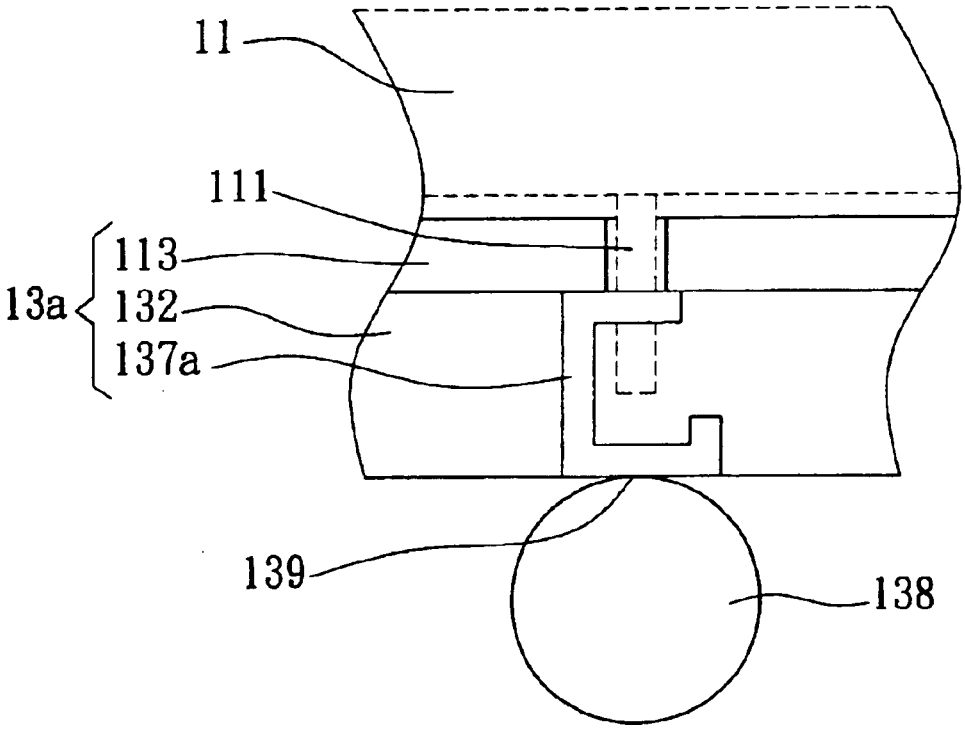
FIG. 4 PRIOR ART
FIG. 4 is an enlargement illustration for the part of holder in the electric connector according to the prior art shown in FIG. 3.

By sliding manner, the sliding cover mechanism 35 is arranged upon the side surface, of the socket 39, facing the IC package 11. When the outside pin-typed IC package 11 is plugged into the pinhole 33 of the socket 39, the sliding cover mechanism 35 make limited sliding displacement to push the pin 111 from the position of the accommodation opening 3421 toward the holding side 3422, such that the IC package 11 is fixed and positioned on the socket 39. Since the choice and application of aforementioned sliding cover mechanism 35 is similar to the structures of the sliding plate and the long pulling rod according to the prior arts shown in FIG. 1 and is not the technical characteristic pursued by the invention, so the detailed construction of the sliding cover mechanism is not presented hereinafter.

One upper surface of the circuit board 40 is electrically connected to the electrical connection device 30. In the preferable embodiment according to the invention, plural solder pads 42 are formed at top side of the circuit board 40 to provide the connection of the corresponding electrical connection parts 343. The positions of the plural solder pads 42 are corresponding to those of the plural pins 33. A non-conducting mask layer 44 is distributed upon the upper surface of the circuit board 40. The mask layer 44 is used to define the position of each solder pad 42, such that each solder pad 42 will not be covered by the mask layer 44 and is exposed to provide the connection with the electrical connection part 343. In other preferable embodiments of the invention described thereinafter, since most parts of the elements are the same as or similar to those described there before, so each of the same elements will be directly assigned with the same name or number, and each of the similar elements will be then assigned with the same name but, for the distinguishing purpose, an English character appended to the previous number.

Figure 8C:
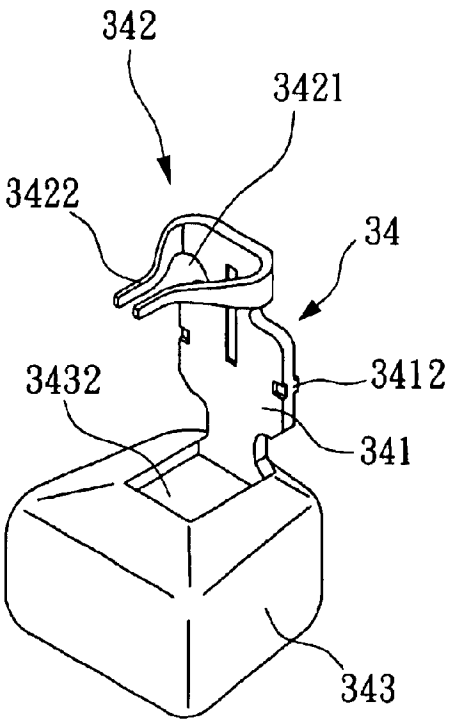
FIG. 8A to FIG. 8C are 3-D structural illustrations for preferable embodiments for the holder with a single extension arm in the electrical connection device according to the invention.
Figure 8B:
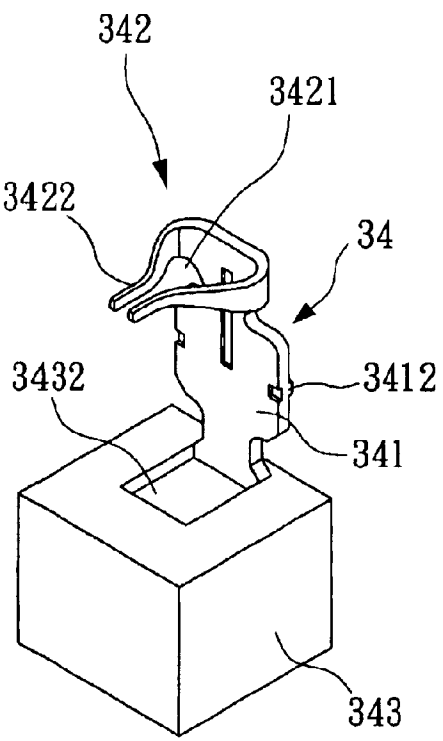
Figure 8A:
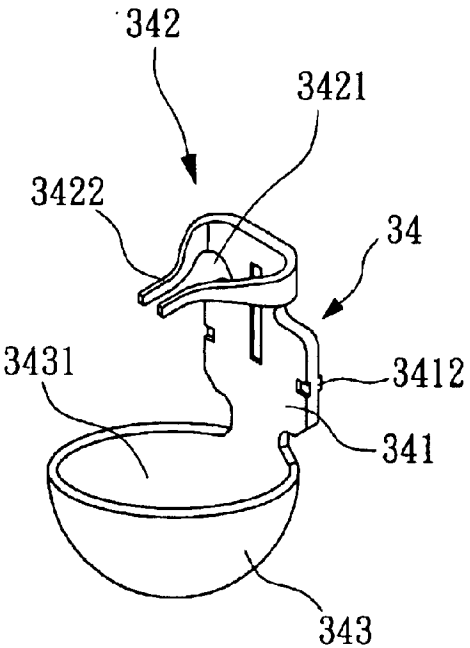

Please refer to FIG. 8A to FIG. 8C, which are 3-D structural illustrations for the holder, having one single extension arm, of the electrical connection device according to several preferable embodiments of the invention. Of course, except for being shown as a round ball structure in FIG. 7, the electrical connection part 343 of the holder 34 also be shown as a semi-round ball shape, a cubic shape, and any irregular shape, etc. Those who are skilled in such art according to aforementioned description will variously execute such sorts of shape variation, so they do not depart from the merits of the invention and are still within the spirit and scope of the invention. Repetitious description will not be presented herein.

Figure 9C:
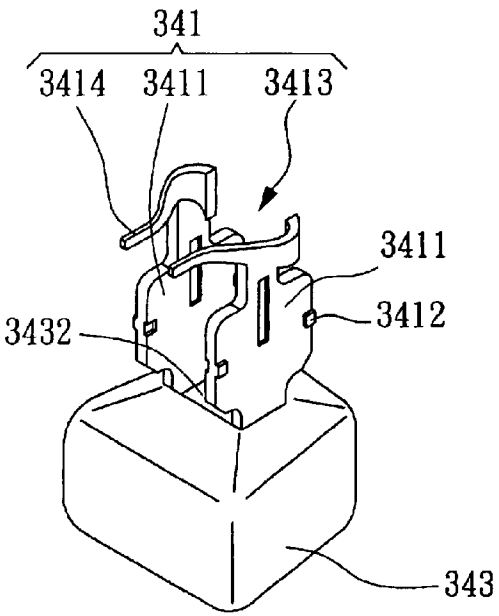
FIG. 9A to FIG. 9F are 3-D structural illustrations for preferable embodiments for the holder with two extension arms in the electrical connection device according to the invention.
Figure 9B:
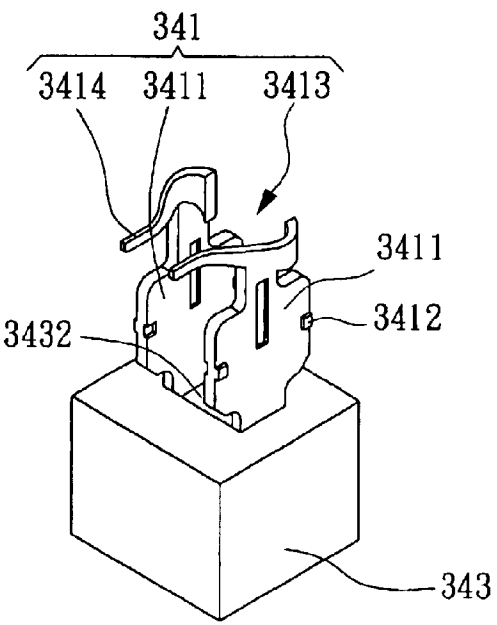
Figure 9A:
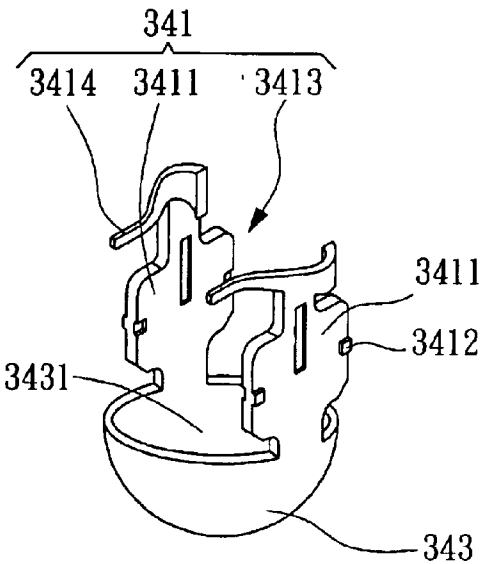
Figure 9F:
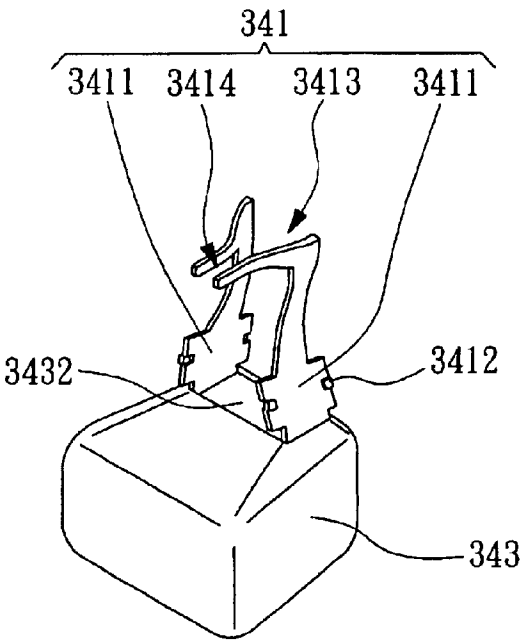
Figure 9E:
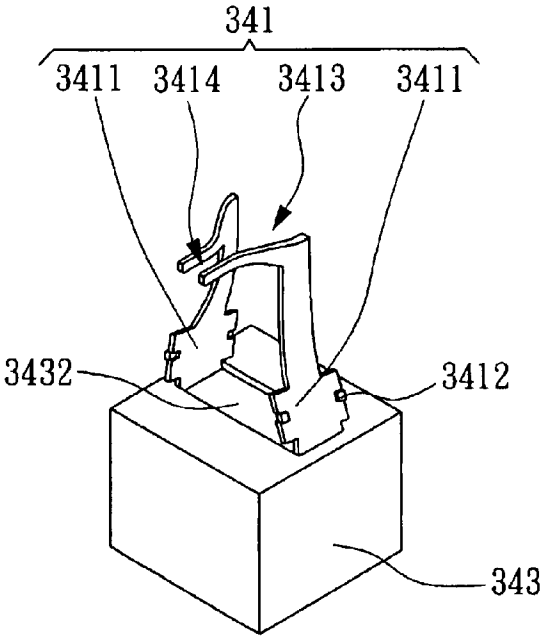
Figure 9D:
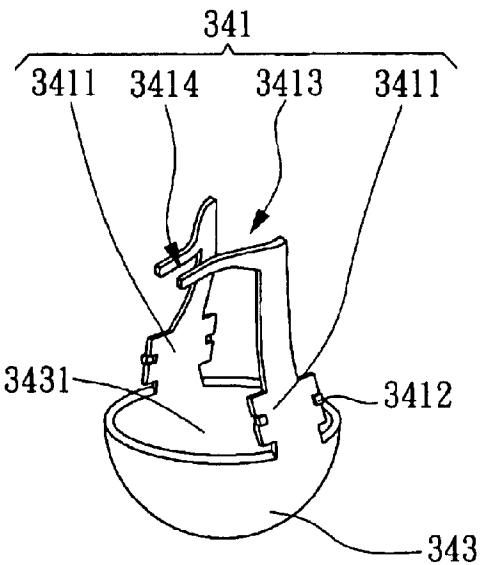

Please refer to FIG. 9A to FIG. 9F, which are 3-D structural illustrations for the holder, having two extension arms, of the electrical connection device according to several preferable embodiments of the invention. Wherein, the extension part 341 includes two extension arms 3411, each of which is extended to same direction and is spaced apart with an appropriate distance. Two extension arms 3411 are extended in parallel (as shown in FIG. 9A to FIG. 9C). Or, two extension arms 3411 be bent to extend not in parallel (as shown in FIG. 9D to FIG. 9F), such that an accommodation opening 3413 of a larger spacing distance and a holding end 3414 of a smaller spacing distance are formed between two extension arms 3411. The spacing distance of the accommodation opening 3413 is larger than the diameter of the pin 111 to receive the pin 111 plugged therein, while the spacing distance of the holding end 3414 is slightly smaller than the diameter of the pin 111 to provide a holding and positioning function. The electrical connection part 343 of the holder 34 is also shown as a semi-round ball shape, a cubic shape, and any irregular shape, etc. Those who are skilled in such art according to aforementioned description will variously execute such sorts of shape variation, so they do not depart from the merits of the invention and are still within the spirit and scope of the invention. Repetitious description will not be presented herein.

What is claimed is:

1. An electrical connection device for providing an electrical Connection between a pin-typed IC package and a circuit board, the electrical connection device comprising:

at least a conductive holder, which is formed by bending a metallic piece into a single component, wherein the conductive holder further comprising:

an extension part;

a holding part, which is located at one end of the extension part and has a predetermined angle with the extension part and, by bending the holding part, an opening is formed to receive a pin of the pin-typed IC package; and an electrical connection part, which is located at another end of the extension part, the electrical connection part being a container with an opening at a top of the container, a resin material being filled in the container and being entirely enclosed by the container except for a surface of the resin material facing toward the opening of the container.

2. The electrical connection device according to claim 1, wherein the holding part includes two holding arms, each of which is extended in same direction and is spaced apart in appropriate distance and, by bending these two holding arms, a larger spacing part and a smaller spacing part are formed between these two holding arms, wherein the larger spacing part can receive the pin plugged therein.

3. The electrical connection device according to claim 1, wherein the extension part has a single extension arm.

4. The electrical connection device according to claim 1, wherein the extension part has two extension arms, each of which is extended in same direction and is spaced apart in appropriate distance.

5. The electrical connection device according to claim 1, wherein the extension part has two extension arms, which are extended not in parallel to form a larger spacing part and a smaller spacing part between the two extension arms, wherein the larger spacing part can receive the pin plugged therein.

6. The electrical connection device according to claim 1, wherein the electrical connection device further comprising a socket, in which at least one pinhole is arranged, and the conductive holder is disposed in the pinhole.

7. The electrical connection device according to claim 6, wherein at least one concave-convex-shaped claw-wedging structure is arranged at an appropriate position of the extension part, and this claw-wedging structure provides a clawing force at the inside wall surface of the pinhole of the socket to avoid the displacement of the conductive holder.

8. An electrical connection device for providing an electrical connection between a pin-typed IC package and a circuit board, the electrical connection device at least comprising:

a socket, in which a plurality of pinholes are arranged and corresponding to a plurality of pins of the pin-typed IC package respectively;

a plurality of conductive holders, each of which is formed by bending a metallic piece into a single component disposed in one of the pinholes respectively, wherein each of the conductive holders further comprising:

an extension part;

a holding part, which is located at one end of the extension part and has a predetermined angle with the extension part, and which is provided to receive one of the pins of the pin-typed IC package; and an electrical connection part, which is located at another end of the extension part, the electrical connection part being a container with an opening at a top of the container, a resin material being filled in the container and being entirely enclosed by the container except for a surface of the resin material facing toward the opening of the container.

9. The electrical connection device according to claim 8, wherein the holding part includes two holding arms, each of which is extended in same direction and is spaced apart in appropriate distance and, by bending these two holding arms, a larger spacing part and a smaller spacing part are formed between these two holding arms, wherein the larger spacing part can receive one of the pins plugged therein, and the electrical connection device further comprises: a sliding cover mechanism, which is arranged on the side surface, of the socket, facing the pin-typed IC package, by a sliding manner for fixing and positioning the pin-typed IC package firmly upon the socket.

10. The electrical connection device according to claim 8, wherein the extension part has a single extension arm.

11. The electrical connection device according to claim 8, wherein the extension part has two extension arms, each of which is extended in same direction and is spaced apart in an appropriate distance, and the electrical connection device further includes: a sliding cover mechanism, which is arranged on the side surface, of the socket, facing the pin-typed IC package, by a sliding manner for fixing and positioning the pin-typed IC package firmly upon the socket.

12. The electrical connection device according to claim 8, wherein the extension part has two extension arms, which are extended not in parallel to form a larger spacing part and a smaller spacing part between the two extension arms, wherein the larger spacing part can receive the pin plugged therein, and the electrical connection device further comprises: a sliding cover mechanism, which is arranged on the side surface, of the socket, facing the pin-typed IC package, by a sliding manner for fixing and positioning the pin-typed IC package firmly upon the socket.

13. The electrical connection device according to claim 8, wherein at least one concave-convex-shaped claw-wedging structure is arranged at an appropriate position of the extension part, and this claw-wedging structure provides a clawing force at the inside wall surface of the pinhole of the socket to avoid the displacement of the conductive holder.

* * * * *